US006186864B1

(12) United States Patent
Fisher, Jr. et al.

(10) Patent No.: US 6,186,864 B1
(45) Date of Patent: Feb. 13, 2001

(54) METHOD AND APPARATUS FOR MONITORING POLISHING PAD WEAR DURING PROCESSING

(75) Inventors: Thomas R. Fisher, Jr., Beacon, NY (US); Mark A. Jaso, Manassas, VA (US); Leonard C. Stevens, Jr., Poughquag, NY (US)

(73) Assignee: International Business Machines Corporation, Armonk, NY (US)

( * ) Notice: Under 35 U.S.C. 154(b), the term of this patent shall be extended for 0 days.

(21) Appl. No.: 09/391,130

(22) Filed: Sep. 7, 1999

Related U.S. Application Data

(62) Division of application No. 08/969,148, filed on Nov. 10, 1997, now Pat. No. 6,045,434.

(51) Int. Cl.[7] ..... B24B 49/00

(52) U.S. Cl. ..... 451/6; 451/9; 451/10; 451/21; 451/41; 451/56; 451/288; 451/290

(58) Field of Search ..... 451/6, 8, 9, 10, 451/11, 21, 41, 56, 59, 288, 289, 290

(56) References Cited

U.S. PATENT DOCUMENTS 5,433,650 * 7/1995 Winebarger ..... 451/6
5,708,506 * 1/1998 Birang ..... 451/6 X
5,733,171 * 3/1998 Allen et al. ..... 451/5
5,823,853 * 10/1998 Bartels et al. ..... 451/5
5,823,854 * 10/1998 Chen ..... 451/9

* cited by examiner

*Primary Examiner*—Timothy V. Eley
(74) *Attorney, Agent, or Firm*—DeLio & Peterson, LLC; Robert Curcio

(57) ABSTRACT

In a chemical-mechanical polishing (CMP) process, semiconductor substrates are rotated against a polishing pad in order to planarize substrate layers. The condition of the polishing pad directly affects the polishing rate of material removal and uniformity of removal from the semiconductor wafer. Conditioning of the polishing pad surface with an abrasive improves polishing uniformity and rates, however, it has the detrimental affect of removing a quantity of pad material. A method and apparatus for monitoring polishing pad wear during processing is developed to extend the pad's useful life, and maintain pad uniformity. This is accomplished in the present invention by measuring and monitoring the diminished pad thickness using a non-intrusive measurement system, and creating a closed-loop system for adjusting the chemical-mechanical polishing tool process parameters. The non-intrusive measurement system consists of an interferometer measurement technique utilizing ultrasound or electromagnetic radiation transmitters and receivers aligned to cover any portion of the radial length of a polishing pad surface. The measurement system is sensitive to relative changes in pad thickness for uniformity, and to abrupt changes such as detecting wafer detachment from the CMP wafer carrier.

21 Claims, 2 Drawing Sheets

METHOD AND APPARATUS FOR MONITORING POLISHING PAD WEAR DURING PROCESSING

This is a divisional of application Ser. No 08/969,148 filed on Nov. 10, 1997, now U.S. Pat. No. 6,045,434.

BACKGROUND OF THE INVENTION

1. Field of the Invention

The present invention relates generally to semiconductor wafer processing techniques using chemical-mechanical polishing, and more particularly to methods and apparatus for measuring the removal of material from a polishing pad.

2. Description of Related Art

During the manufacture of integrated circuits it is necessary to polish a thin wafer of semiconductor material in order to remove material and dirt from the wafer surface. Typically, a wet chemical abrasive or slurry is applied to a motor driven polishing pad while a semiconductor wafer is pressed against it in a process well known in the prior art as chemical-mechanical polishing (CMP). The polishing platen is usually covered with a soft wetted material such as blown polyurethane. The polishing effects on the wafer result from both the chemical and mechanical action.

The polishing pad contacts the wafer surface while both wafer and pad are rotating on different axes. The rotation facilitates the transport of the abrasive containing polishing slurry between the pad and the wafer. The choice of polishing pad and slurry is determined by the material being polished, and the desired flatness of the polished surface.

Apparatus for polishing thin flat semiconductor wafers are well known in the art. U.S. Pat. Nos. 4,193,226 and 4,811,522 to Gill, Jr. and U.S. Pat. No. 3,841,031 to Walsh, for instance, disclose such apparatus.

The condition of the polishing pad directly affects the polishing rate of material removal and uniformity of removal from the semiconductor wafer. The material of the polishing pad is also chosen for its ability to act as a carrier of the slurry and to wipe away the grit and debris resulting from the polishing action.

The hardness of the pad has a strong influence on wafer flatness. The use of hard and less compressible pads made of urethane materials, e.g., IC series pads from Rodel, Inc., results in surfaces with reduced topography when compared to pads made from urethane foam, e.g., Politex pads from Rodel, Inc., or felt polishing pads.

However, urethane pads have a porous structure throughout. During polishing, slurry can accumulate in the pore structure. This diminishes the polishing removal rate and degrades the polishing removal uniformity. To reduce these effects, the pores on the pad surface may be opened or a fresh pad surface exposed. These processes are commonly referred to as pad conditioning.

Conditioning may take place during or after the polishing process. The most common method of pad conditioning is a mechanical abrasion of the pad surface. Materials such as steel blades or abrasive wheels are often used. While conditioning of the pad surface improves polishing uniformity and rates, it has the detrimental effect of removing a quantity of pad material.

This presents the problem encountered in the process of pad conditioning, and chiefly addressed by the present invention: the unregulated, non-uniform removal of pad material. If the abrasion of the pad material is not uniform across the pad surface that contacts the wafer, the polishing uniformity and the pad's useful lifetime will be adversely affected. The ideal pad surface after conditioning should be flat (no curvature within the conditioned area).

Additionally, there are occasions when the semiconductor wafer, secured in the wafer carrier during polishing, is dislodged from the wafer carrier. When this occurs, the polishing process subjects the unrestrained wafer to damage. A method to monitor pad degradation that includes detecting the presence of a dislodged semiconductor wafer would enhance the effectiveness and efficiency of the polishing process.

Presently, the only ways available to measure the pad material removal are destructive to the pad; cutting a piece from the pad and using a micrometer to measure thickness, or contacting the pad using a micrometer and a straightedge across the pad surface. Thus, pad destruction or pad contamination may result from measurements currently made in the prior art.

Predominantly, the effectiveness of the CMP process has been monitored by measuring the degree of planarization of the semiconductor wafer itself. End point detection schemes have been enacted to monitor the removal of material on a semiconductor substrate without removing the devices formed underneath the material. Typically, this planarization process is accomplished by control of the rotational speed, downward pressure, chemical slurry, and time of polishing of the CMP process.

A number of optical and other methods exist for determining when polishing endpoint on the semiconductor wafer has occurred. These methods monitor the wafer itself and include acoustical wave generation and detection, thermal imaging, friction sensing, impedance or capacitance measurements, monitoring the current of the motor used to rotate the wafer against a polishing pad, stylus profilometry, phase shift interferometry, light scattering analysis, scanning tunneling microscopy, and three dimensional optical profiling.

U.S. Pat. No. 5,081,796, issued to Schultz on Jan. 21, 1992, entitled, "METHOD AND APPARATUS FOR MECHANICAL PLANARIZATION AND ENDPOINT DETECTION OF A SEMICONDUCTOR WAFER", teaches a laser interferometer measuring device employed to detect the thickness of a material being planarized. However, the non-uniformity of polishing pad material removal is not addressed, as the polishing pad thickness or its relative change is not measured or monitored.

U.S. Pat. No. 5,222,329, issued to Yu on Jun. 29, 1993, entitled, "ACOUSTICAL METHOD AND SYSTEM FOR DETECTING AND CONTROLLING CHEMICAL-MECHANICAL POLISHING (CMP) DEPTHS INTO LAYERS OF CONDUCTORS, SEMICONDUCTORS, AND DIELECTRIC MATERIALS", teaches a method for sensing acoustical waves generated when the depth of material removal on the semiconductor substrate reaches a certain determinable distance from the interface and generates specifically defined detection signals. However, this passive acoustical technique deals with a method of polishing and monitoring for end point detection on the semiconductor wafer, not a method for monitoring or measuring a change in the polishing pad thickness. Nor does this technique employ an active radiation source in its measurement scheme.

U.S. Pat. No. 5,461,007, issued to Kobayashi on Oct. 24, 1995, entitled, "PROCESS FOR POLISHING AND ANALYZING A LAYER OVER A PATTERNED SEMICONDUCTOR SUBSTRATE", teaches a reflected radiation beam or radiation scattering analyzer approach to monitoring the polishing layer over a previously patterned semiconductor substrate. A detector analyzes the reflected beam to determine a detected intensity. The reflected beam's intensity is a function of the reflection angle which correlates to different layer depths on the substrate. Thus, it may correlate to when a polishing end point has been reached. Although the general measurement technique utilizes reflected radiation, beam intensity is the sole operational parameter, not an interferometer technique utilizing phase change or time delay. Also, once again, the polishing pad itself is not monitored or measured in this prior art.

As shown from the prior art, the condition of the polishing pad surface, although adversely affecting planarization, is not an operational parameter that has been monitored or measured. Consequently, although the effects of a degraded polishing pad have been acutely addressed by analyzing the semiconductor wafer, an approach to monitor the polishing pad itself and measure the particle removal as a function of pad surface depth is novel to this invention.

Bearing in mind the problems and deficiencies of the prior art, it is therefore an object of the present invention to provide a method and apparatus for monitoring and measuring the diminished thickness in a polishing pad.

It is another object of the present invention to provide a method and apparatus of the type described which operates non-intrusively to the chemical-mechanical polishing process, not relying on physical contact as a method for layer removal monitoring.

A further object of the present invention is to provide a method and apparatus of the type described which utilizes an active measurement system with a radiated energy source and detector to monitor and measure the diminished thickness of a polishing pad.

It is another object of the present invention to provide a method and apparatus of the type described which utilizes an ultrasonic or laser interferometer measurement system to monitor and measure the diminished thickness of a polishing pad.

A further object of the invention is to provide a method and apparatus of the type described which monitors and measures, in situ, the relative change in thickness of the polishing pad.

It is another object of the present invention to provide a method and apparatus of the type described which utilizes a closed-loop feedback process to control the chemical-mechanical polishing in real time in order to minimize the degradation in polishing pad uniformity.

It is yet another object of the present invention to provide a method and apparatus of the type described which can detect the release of a semiconductor wafer from the chemical-mechanical polishing tool wafer carrier during polishing.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a method for monitoring polishing pad thickness and adjusting pad conditioning operational parameters comprising the steps of: a) measuring a relative change in the polishing pad thickness; and, b) adjusting the pad conditioning parameters as a result of the measurements such that degradation of the pad thickness uniformity is minimized.

In another aspect, the present invention is related to the method for monitoring polishing pad thickness wherein the measurement of the polishing pad is taken during polishing or between intervals of polishing of a wafer attached to a wafer carrier, and further including the step of sensing when a wafer has detached from the wafer carrier through an abrupt change in the pad thickness measurement.

In a further aspect, the present invention is directed to adjusting the pad conditioning parameters. This comprises a closed-loop feedback process of monitoring the relative change in the pad thickness and compensating for non-uniformity by adjusting pad conditioning operational parameters. The closed-loop feedback process comprises the steps of: i) applying control signals to a chemical-mechanical polishing tool controller; and, ii) processing output signals from the controller to adjust the pad conditioning parameters.

In another aspect, the present invention is directed to a method for monitoring a polishing pad comprising the steps of: a) providing a non-contacting measurement system adapted to determine relative distance from a sensor to an object; b) disposing the sensor adjacent to and a predetermined distance from the pad; c) measuring the distance from the sensor to the polishing surface of the pad; d) polishing a semiconductor wafer with the polishing surface; e) re-measuring the distance from the sensor to the polishing surface; and, f) determining polishing pad condition by comparing the measurements in the preceding steps (c) and (e) above.

In a further aspect, the present invention is directed to the method where the measuring of the distance from the sensor to the polishing pad surface is a non-intrusive measurement. One way to accomplish this is to have the non-contacting measurement system provide radiation from a source external to the polishing pad which is reflected off the polishing pad surface. The measuring of the distance from the sensor to the pad surface then comprises measuring the wave propagation time difference or phase change between two signals from the radiation source, reflected off the polishing pad surface and delivered at different times in the measurement process, to establish a relative change in distance traveled by the later measurement signal. Lastly, determining polishing pad condition is performed by correlating a change in the wave propagation distance to a change in polishing pad thickness.

Another aspect of the present invention is the method wherein the non-contacting measurement system uses an interferometer measurement technique, wherein measuring the distance from the sensor to the polishing surface comprise the steps of: i) directing a radiation signal onto the polishing pad surface at the onset of the polishing process; ii) detecting the returned reflection of the radiation signal from the polishing pad surface as a reference signal; iii) directing the radiation signal onto the polishing pad surface at intervals throughout the polishing process; iv) detecting the returned reflection of the radiation signal of step (iii) as a measurement signal; and, wherein determining the polishing pad condition further comprises comparing the reference signal to the measurement signal by measuring phase change or time delay between the reference and the measurement signals, to establish a relative change in distance traveled by the measurement signal from the reference signal, correlating to a change in polishing pad thickness.

In a further aspect, the method cited above is directed wherein the radiation from a source external to the polishing pad surface is either ultrasound energy or electromagnetic energy. The radiation directed onto the polishing pad surface is produced by a transducer capable of delivering the energy over frequency ranges and intensities such that a radiated wave reflecting off the polishing pad surface is detectable by an ultrasound sensor or electromagnetic sensor, respectively.

In a further aspect of the present invention, the change in polishing pad thickness is measured over a plurality of sites on the pad for determining pad surface uniformity.

In yet another aspect, the polishing pad is circular and the radiation delivered over the plurality of sites is performed by a single sensor scanning the pad surface in a radial direction.

In another aspect the radiation delivered over the plurality of sites is performed by multiple sensors aligned in an array across the pad surface in a radial direction.

In association with the aspects of the present invention delineating methodology are the apparatus aspects responsible for implementing the methods cited above. In the first aspect is an apparatus for monitoring the uniformity of a polishing pad used in a chemical-mechanical polishing process, comprising: a means for measuring diminished thickness of the polishing pad; and, a means for adjusting a chemical-mechanical polishing process tool based on information obtained from the means for measuring the diminished thickness of the polishing pad such that, when adjusted, the tool will compensate for pad degradation and maintain pad thickness uniformity.

In another aspect of this apparatus, the means for measuring is non-intrusive.

In a further aspect, the apparatus cited above is directed to monitor the uniformity of a polishing pad surface used in a chemical-mechanical polishing process, comprising: a chemical-mechanical polishing tool for planarizing semiconductor wafers; a base for providing mechanical support for non-intrusive measurement sensors; a radiation transducer for delivering energy in the form of propagating waves to the pad surface; a radiation receiver for detecting reflected energy from the pad surface; an analyzer capable of distinguishing a time delay or phase change between two propagating waves corresponding to a resolution capable of distinguishing incremental changes in thickness of the polishing pad surface; and, a controller capable of receiving information from the analyzer and capable of adjusting chemical-mechanical polishing tool operational parameters such that pad uniformity is monitored and maintained during the polishing process.

In a further aspect, the apparatus cited above employs a radiation transducer and radiation receiver that are combined in one sensor.

In yet another aspect, the apparatus uses non-intrusive measurement sensors comprising radiation transducers and radiation receivers that are capable of delivering and detecting ultrasound or electromagnetic radiation.

In a further aspect, the apparatus cited above requires that the polishing pad is circular and the radiation transducer be comprised of multiple sensors aligned in a radial direction on the polishing pad, such that the sensors encompass the entire radial length of the pad surface or a portion thereof.

In another aspect, the apparatus requires the radiation transducer to be movable over the radial length of the pad surface or a portion thereof. The radiation transducer comprises a single sensor mounted above the chemical-mechanical polishing tool such that the sensor is electro-mechanically controlled by an electro-mechanical motor.

In another aspect, the apparatus cited above utilizes a polishing pad that is circular and a radiation receiver that comprises multiple sensors aligned in a radial direction on the polishing pad, such that the sensors encompass the entire radial length of the pad surface or a portion thereof.

In another aspect, the apparatus requires the radiation receiver to be movable over the radial length of the pad surface or a portion thereof. The radiation receiver comprises a single sensor mounted above the chemical-mechanical polishing tool such that the sensor is electro-mechanically controlled by an electro-mechanical motor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
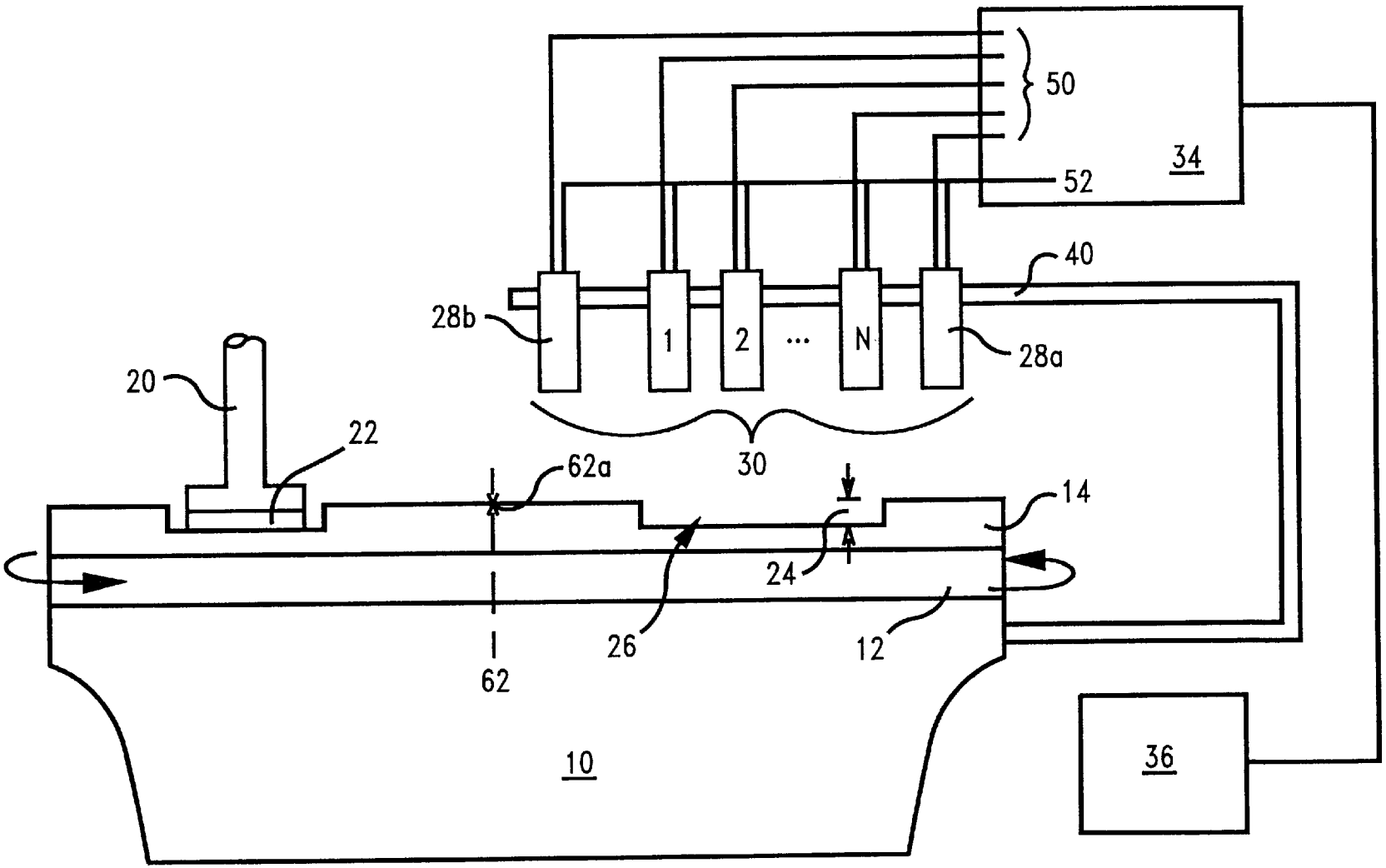
FIG. 1 is an elevational view of a functional diagram of a non-intrusive measurement system with multiple sensor/detector sites over the conditioning area of the polishing pad.

In describing the preferred embodiment of the present invention, reference will be made herein to FIGS. 1 and 2 of the drawings in which like numerals refer to like features of the invention. Features of the invention are not necessarily shown to scale in the drawings.

The present invention addresses the problems associated with the prior art of: a) removing polishing pad material in an unregulated, non-uniform manner; b) extending the polishing pad's useful life; c) maintaining and improving polishing pad uniformity throughout the chemical-mechanical polishing process; d) performing pad monitoring without damaging the pad surface; and, e) sensing when wafers being polished come off the wafer carrier and remain on the polishing table.

This is accomplished in the present invention by measuring and monitoring the diminished pad thickness using a non-intrusive, non-contacting measurement system, and creating a closed-loop system for adjusting the chemical-mechanical polishing tool's process parameters. Quantitative assessments of pad thickness will lead to better control of pad uniformity. Non-intrusive measurements will mitigate the damaging effects in the prior art of attempting to measure a change in pad thickness.

A preferred CMP pad monitoring apparatus is shown in FIG. 1. This apparatus performs the functions of measuring a change in a polishing pad thickness, and adjusting chemical-mechanical polishing parameters as a result of these measurements.

As depicted in FIG. 1, a CMP tool 10 rotates a polishing pad platen 12 about axis 62 with a polishing pad 14 attached. Polishing pad 14 consists of an abrasive material, typically a urethane based substance, to planarize or remove material from semiconductor wafer 22. Wafer 22 is pressed against the polishing pad surface by wafer carrier 20. This continued compression and polishing action creates an indentation in the polishing pad surface which then requires pad conditioning to extend the pad's useful life. Pad conditioning creates non-uniformity in the pad's surface. The diminished pad thickness 24 is caused by the removal of pad material in the area where wafer 22 is polished or where the pad surface is conditioned. The latter is shown in FIG. 1 as pad conditioning area 26. By measuring the relative change in diminished pad thickness 24, it is possible to monitor the pad uniformity throughout the chemical-mechanical process.

Preferably, the measurement of relative change in pad thickness 24 is performed by an interferometer method. Radiation from either an ultrasound or electromagnetic source is produced by sensors 28 aligned along pad conditioning area 26 in a radial direction from the circular pad's center 62*a* to the outer most edge of the pad conditioning area.

It should be noted that the sensors may also extend the complete length of the pad's radius or any portion thereof in order to monitor more of the pad's surface.

The latter approach will more easily enable the monitoring system to indicate when wafer 22 has detached from wafer carrier 20 and is freely traversing across the pad's surface. This is accomplished by the sudden increase in pad thickness measured in the area where detached wafer 22 is detected. Coverage of the complete pad surface or a portion thereof larger than pad conditioning area 26 can be easily accommodated by expanding the sensor array structure 30 in a radial direction, as shown by sensors 28*a* and 28*b*.

Sensor array structure 30 constitutes an array of sensors 28 aligned over the pad surface and mounted to support 40. Support 40 is capable of holding a plurality of sensors that traverse the pad surface in a radial direction from pad center 62*a* to the outside edge of the pad, or any portion thereof. Support 40 may attach to chemical-mechanical polishing tool 10 or any other stationary structure capable of remaining free of extraneous vibrations during measurements.

Each sensor 28 is a transmitter and receiver of radiated energy (although these functions may be performed by distinct and separate devices). An interferometer measuring technique is then performed by the measuring system.

The signal analyzer 34 sends output signal 52 to each sensor 28 to activate each sensor's transducer/transmitter in order to send a modulated wave to the pad's surface. The first signal is commonly labeled a reference signal. A reference signal is typically taken when the pad is first installed on the chemical-mechanical polishing tool. A reflected wave propagates back to the sensor's detector from the pad surface where it is converted into an electronic signal. The electronic signal from sensor 28 is then sent to input port 50 of signal analyzer 34. The signal's travel time or phase is then recorded in signal analyzer 34.

Next, signal analyzer 34 sends output signal 52 to each sensor 28 in order to send a modulated wave to the pad surface as a measuring signal. The measuring signal's reflected wave propagates back to the sensor detector. The time of the measuring signal's travel or the measuring signal's phase is then recorded and compared to the reference signal's measured values. The difference in either time or phase is correlated to the extra distance traveled by the measuring signal. This distance represents a relative change in pad thickness 24.

This measuring technique is best performed when the polishing slurry, an aqueous abrasive on the pad surface, has been removed from the pad surface at different stages in the chemical-mechanical polishing process. Polishing slurry will affect both the amount of reflected energy returned to sensor 28 and the measured change in pad thickness 24.

With data inputted from each sensor 28 of sensor array 30, it is possible to ascertain the relative change in pad thickness 24 throughout the area of sensor coverage. As explained above, this area of coverage may be greater than the area of pad conditioning 26. This relative change in pad thickness quantifies the degradation in pad uniformity experienced by the polishing and conditioning process.

Information of any measured change in pad uniformity is then sent to the chemical-mechanical polishing tool controller 36. Polishing operational parameters such as rotational speed, downward pressure of wafer 22, amount of chemical polishing slurry, and the time of polishing, are then adjusted by controller 36 to compensate for the measured relative change in pad thickness. Through this closed-loop feedback process, pad uniformity may be continuously monitored and consistently maintained.

Figure 2:
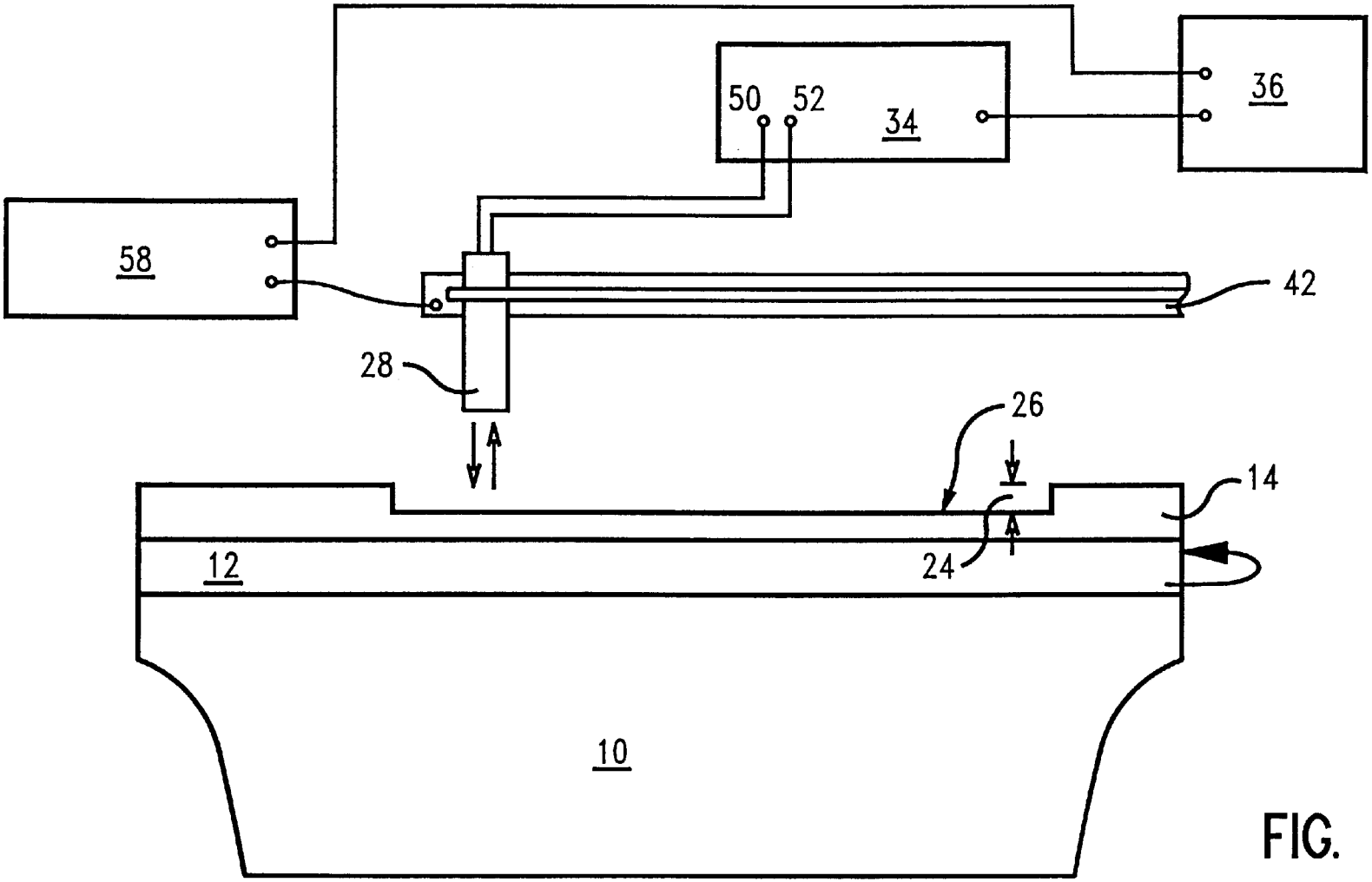
FIG. 2 is an elevational view of a functional diagram of a non-intrusive measurement system with a single sensor/detector electro-mechanically capable of scanning the polishing pad surface.

FIG. 2 depicts a single sensor measurement system. Here, sensor 28 is attached to a scanning sensor support structure 42 capable of moving the sensor over a radial path of circular polishing pad 14. Support structure 42 allows sensor 28 to traverse the pad surface in a radial direction from pad center 62*a* (not shown) to the outside edge of the pad, or any portion thereof. In this way, sensor 28 can scan the pad surface at multiple intervals during the measurement process. Support structure 42 may attach to the chemical-mechanical polishing tool 10 or any other stationary structure capable of remaining free of extraneous vibrations during measurements. Attachment of support structure 42 to a stationary structure is not shown.

The movement of sensor 28 is governed by an electromechanical motor 58 controlling the scanning sensor support structure 42. The motor may be controlled by chemical-mechanical polishing tool controller 36, shown here, or other computer controller, based upon information received from signal analyzer 34 on each individual measurement taken to indicate the relative change in pad thickness during the course of wafer polishing and pad conditioning.

In a similar fashion to the measurement system depicted in FIG. 1, at each scanning position sensor 28 of FIG. 2 is prompted by output port 52 from signal analyzer 34 to transmit a modulated wave to the pad surface. A reflected signal is then detected by the sensor 28 detector and converted to an electronic signal capable of analysis by signal analyzer 34. This signal is designated as a reference signal. The same measurement is again repeated, after polishing or conditioning, only now the signal is designated a measurement signal. Each measurement signal is then compared with each corresponding reference signal at each scanning position to determine the measurement's signal relative change in time or phase. The difference in either time or phase is correlated to the extra distance traveled by the measuring signal. This extra distance traveled by the measuring signal represents a change in pad thickness 24.

The scanning sensor may cover the entire radial length of the circular pad or some smaller portion thereof. Consequently, this area of coverage may be greater than the area of pad conditioning 26, or the indentation area created by wafer carrier 20 (not shown) compressing wafer 22 against the pad surface. Once again, any measured relative change in pad thickness quantifies the degradation in pad uniformity experienced by the polishing process.

Information is then sent from signal analyzer 34 to chemical-mechanical polishing tool controller 36 in order to adjust operational parameters necessary to maintain pad uniformity.

Similar to the sensor array configuration of FIG. 1, if the measurement coverage area of the scanning sensor depicted in FIG. 2 is large enough, and the measurement resolution sensitive enough, the system can be capable of determining when wafer 22 has detached from wafer carrier 20 by detecting a sudden measured change in pad thickness.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for monitoring a polishing pad having a polishing surface comprising the steps of:

a) providing a non-contacting measurement system adapted to determine a change in distance from a sensor to said polishing pad surface;

b) disposing said sensor adjacent to and a predetermined distance from said pad;

c) measuring the distance from said sensor to said polishing surface of said pad;

d) polishing a semiconductor wafer with said polishing surface;

e) re-measuring the distance from said sensor to said polishing surface; and f) determining said change in distance by comparing the measurements in steps (c) and (e).

2. The method of claim 1 wherein said measuring of said distance from said sensor to said polishing pad surface comprises non-intrusive measurement.

3. The method of claim 1 wherein said non-contacting measurement system provides radiation from a source external to said polishing pad which is reflected off said polishing pad surface, and wherein said measuring of said distance from said sensor to said pad surface comprises measuring one of the following parameters: the wave propagation time difference or phase change between a first and second signal from said radiation source, said first and second signals reflected off said polishing pad surface and delivered at different times during said measuring, to establish said change in distance traveled by said second signal with respect to said first signal, and wherein determining said change in distance is by correlating a change in said wave propagation time difference or phase change to a change in polishing pad thickness.

4. The method of claim 3 wherein said radiation from a source external to said polishing pad surface is ultrasound energy.

5. The method of claim 4 wherein said radiation directed onto said polishing pad surface is produced by a transducer capable of delivering ultrasound energy over frequency ranges and intensities such that a radiated wave reflecting off said polishing pad surface is detectable by an ultrasound sensor.

6. The method of claim 3 wherein said change in polishing pad thickness is measured over a plurality of sites on the pad for determining pad surface uniformity.

7. The method as recited in claim 6 wherein said polishing pad is circular and said radiation delivered over said plurality of sites is performed by a single sensor scanning said pad surface in a radial direction.

8. The method as recited in claim 6 wherein said polishing pad is circular and said radiation delivered over said plurality of sites is performed by multiple sensors aligned in an array across said pad surface in a radial direction.

9. The method defined in claim 3 wherein said radiation from a source external to said polishing pad surface is electromagnetic energy.

10. The method of claim 9 wherein said radiation directed onto said polishing pad surface is produced by a transmitter capable of delivering electromagnetic energy over frequency ranges and intensities such that a radiated wave reflecting off said polishing pad surface is detectable by an electromagnetic sensor.

11. The method of claim 1 wherein said non-contacting measurement system uses an interferometer measurement technique for measuring the distance from said sensor to said polishing surface of said steps 5(*c*) and 5(*e*), said method further comprising the steps of:

i) directing a radiation signal onto said polishing pad surface at the onset of said measuring;

ii) detecting a first returned reflection signal of said radiation signal from said polishing pad surface as a reference signal;

iii) directing said radiation signal onto said polishing pad surface at intervals throughout said polishing process;

iv) detecting a subsequent returned reflection signal for each of said radiation signal of step (iii) directed in said intervals, said reflection signal used as a measurement signal to be compared with said first returned reflection signal; and wherein determining said change in distance of said step 5(*f*) further comprises comparing said reference signal to said measurement signal by measuring one of the following parameters: phase change or time delay between said reference signal and said measurement signal, to establish said change in distance traveled by said measurement signal with respect to said reference signal, correlating to a change in polishing pad thickness.

12. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process.

13. The apparatus of claim 12 wherein said radiation transducer and radiation receiver are combined in one sensor.

14. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said non-intrusive measurement sensors comprising said radiation transducer and said radiation receiver are capable of delivering and detecting ultrasound radiation.

15. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said non-intrusive measurement sensors comprising said radiation transducer and said radiation receiver are capable of delivering and detecting electromagnetic radiation.

16. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said polishing pad is circular and said radiation transducer comprises multiple sensors aligned in a radial direction on said polishing pad, such that said sensors encompass the entire radial length of said pad surface or a portion thereof.

17. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said polishing pad is circular and said radiation transducer is movable over the radial length of said pad surface or a portion thereof.

18. The apparatus of claim 17 wherein said radiation transducer comprises a single sensor mounted above said chemical-mechanical polishing tool such that said sensor is electro-mechanically controlled by an electro-mechanical motor.

19. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said polishing pad is circular and said radiation receiver comprises multiple sensors aligned in a radial direction on said polishing pad, such that said sensors encompass the entire radial length of said pad surface or a portion thereof.

20. An apparatus for monitoring the uniformity of a polishing pad surface used in a chemical-mechanical polishing process, comprising:

a chemical-mechanical polishing tool for planarizing semiconductor wafers;

a base for providing mechanical support for non-intrusive measurement sensors;

a radiation transducer for delivering energy in the form of propagating waves to said pad surface;

a radiation receiver for detecting reflected energy from said pad surface;

an analyzer capable of distinguishing a time delay or phase change between said propagating waves corresponding to a resolution capable of distinguishing incremental changes in thickness of said polishing pad surface; and a controller capable of receiving information from said analyzer and capable of adjusting chemical-mechanical polishing tool operational parameters such that pad uniformity is monitored and maintained during said polishing process;

wherein said polishing pad is circular and said radiation receiver is movable over the radial length of said pad surface or a portion thereof.

21. The apparatus of claim 20 wherein said radiation receiver comprises a single sensor mounted above said chemical-mechanical polishing tool such that said sensor is electro-mechanically controlled by an electro-mechanical motor.

* * * * *